US006882260B2

(12) United States Patent
Katzir et al.

(10) Patent No.: US 6,882,260 B2
(45) Date of Patent: Apr. 19, 2005

(54) METHOD AND APPARATUS FOR INSULATING A PLANAR TRANSFORMER PRINTED CIRCUIT AND LEAD FRAME WINDINGS FORMS

(75) Inventors: Eli Katzir, Herzlia (IL); Yacov Dekel, Ashkelon (IL)

(73) Assignee: Payton Ltd., Rishon Le Zion (IL)

( * ) Notice: Subject to any disclaimer, the term of this patent is extended or adjusted under 35 U.S.C. 154(b) by 569 days.

(21) Appl. No.: 09/858,521

(22) Filed: May 17, 2001

(65) Prior Publication Data

US 2001/0042905 A1 Nov. 22, 2001

(30) Foreign Application Priority Data

May 22, 2000 (IL) ..... 136301

(51) Int. Cl.[7] ..... H01F 5/00

(52) U.S. Cl. ..... 336/200; 336/223; 336/232; 29/602.1

(58) Field of Search ..... 336/223, 200, 336/232; 29/602.1

(56) References Cited

U.S. PATENT DOCUMENTS 4,873,757 A * 10/1989 Williams ..... 29/602.1
5,353,001 A 10/1994 Meinel et al.
5,463,365 A * 10/1995 Iwatani et al. ..... 336/98
5,801,611 A * 9/1998 Van Loenen et al. ..... 336/200
5,949,321 A 9/1999 Grandmont et al.
5,952,909 A 9/1999 Umeno et al.
6,000,128 A 12/1999 Umeno et al.
6,252,486 B1 * 6/2001 Wolf ..... 336/200

FOREIGN PATENT DOCUMENTS

| | | | |
|---|---|---|---|
| EP | 476114 | 3/1992 | |
| EP | 506362 | 9/1992 | |
| EP | 608127 | 7/1994 | |
| EP | 673044 | 9/1995 | |
| EP | 971557 | 1/2000 | |
| GB | 2250383 | 6/1992 | |
| JP | 08236365 A * | 9/1996 | ..... H01F/27/32 |

* cited by examiner

*Primary Examiner*—Anh Mai
(74) *Attorney, Agent, or Firm*—Eitan, Pearl, Latzer & Cohen Zedek, LLP

(57) ABSTRACT

The invention relates to a planar coil circuit and provides an improved method for insulating a face of a planar circuit of the type typically used in a transformer, while leaving the terminals thereof exposed; and to a planar printed circuit or lead frame stamped or etched solid copper similar to printed circuits but with no base material core manufactured using this method.

12 Claims, 3 Drawing Sheets

METHOD AND APPARATUS FOR INSULATING A PLANAR TRANSFORMER PRINTED CIRCUIT AND LEAD FRAME WINDINGS FORMS

FIELD AND BACKGROUND OF THE INVENTION

The present invention relates to a planar coil circuit

More particularly, the invention provides an improved method for insulating a face of a planar circuit of the type typically used in a transformer, while leaving the terminals thereof exposed; and to a planar printed circuit or lead frame stamped or etched solid copper similar to printed circuits but with no base material core manufactured using this method.

In long-established practice wound magnetic components such as transformers, solenoids, choke coils, loudspeakers, motors and other magnetic components use multiple coils of round section wires to generate a magnetic field. The round wire carries a thin coat of insulation, and the coil becomes part of a low-cost and reliable component. Power/space efficiency however is not optimum due to the inevitable spaces formed when a plurality of circles or cylinders are brought into contact.

In recent years it has been found that flat magnetic coil components can be produced by the same technology which has long been used for printed circuit boards.

The principal advantage gained by the planar form is that a larger number of coils as a printed circuit and or lead frames can be fitted in to the equivalent space required by round-section wire. The planar printed coil opens up many design options, one of which is that the coil can be of any shape and width, and multiple coils on one face are possible. A wide conductor makes possible high current flow. Weight reduction is another benefit, this being of particular interest in aerospace applications. The planar circuits can be, and in most cases are interconnected with other circuits to generate a magnetic field and to meet a broad array of requirements. Thus a combination of circuits can be used to build a transformer, for example as proposed in U.S. Pat. No. 5,949,321.

Production methods and descriptions of planar circuits are known, see for example U.S. Pat. No. 5,952,909 and No. 6,000,128 to Umeno et al.

Each planar circuit usually needs to be insulated from adjacent circuits and almost always from a ferrite core passing through the planar coil. However the terminals of the circuit need to be exposed so that electrical connections can be attached thereto. The assembly of the circuits is done manually placing insulating material in between two coil circuits. Such assembly is a time and labor consuming operation. In order to overcome the manual assembly operation it has been suggested to insulate the circuits beforehand.

The three known methods of insulating planar circuits are not completely satisfactory.

A liquid solidifying dielectric coating is easy to apply. However the thickness of the coating obtained shows significant variation, particularly in the vicinity of irregular copper shapes printed on the substrate, The coating can also become porous after drying, allowing an electrical discharge when the circuit is in use. In order to meet safety standards, such coatings require testing to conform to standards, and such testing increasing costs.

Conventionally applied polymeric films do not cover the conductors on all sides, and fail to cover the edges of the copper conductors. Application requires skilled workers, and the result is not optimum regarding space utilization.

Bobbins are widely used for supporting coils but the hollow central tube thereof prevents the metallic winding from close proximity to the ferrite core, reducing the efficiency of the magnetic circuit.

OBJECTS OF THE INVENTION

It is therefore one of the objects of the present invention to obviate the disadvantages of prior art methods and to provide a process which provides an even, strong, heat-resistant, securely-attached and reliable insulation covering, without exceeding the thickness to the component being insulated.

It is a further object of the present invention to provide a method which will allow addition of said insulation to many individual circuits at one time while greatly reducing labor costs.

Yet a further object is to provide an insulation method which will withstand heat to an extent that it is possible to tin-lead coat the terminals after the insulation sheet has been applied to the printed circuit board.

SUMMARY OF THE INVENTION

The present invention achieves the above objects by providing a planar transformer component comprising a first flat coil projecting from a first face of a printed circuit panel, the coil surrounding an aperture sized to allow projection therethrough of a ferrite core member. Terminals for the coil are provided adjacent to an edge of the panel, the exposed face and edges of the coil, including the edges of said aperture being insulated by a heat-resisting plastic film adhesively attached to the panel, and to the coil face and to the coil edges. The film is provided with cut-outs leaving the terminals exposed for subsequent electrical connection.

In a preferred embodiment of the present invention there is provided a method for manufacturing a planar transformer component likewise a printed circuit or a lead frame comprising the steps:

manufacturing by prior art methods a printed circuit panel containing an array of individual coil circuit components, each circuit component having at least two terminals, apertures being provided proximate to the center of each coil sized to allow insertion therein of a ferrite core member;

providing a sheet of polyimide film sized to cover the printed circuit panel, said sheet being provided with an array of cut-outs positioned to correspond to the locations of said terminals, and being coated on at least one side with an inactivated adhesive;

positioning said sheet on the circuit panel;

stacking a plurality of printed circuit panel with said sheets and effecting adhesion of the sheet to the panel by applying heat and axial pressure to the stack;

if necessary applying a metallic coating to said terminals; and cutting the printed circuit panel into components, each carrying at least one coil.

In a most preferred embodiment of the present invention, step d) of the method is carried out under vacuum.

Yet further embodiments of the invention will be described hereinafter.

It will thus be realized that the novel method of the present invention utilizes a high quality, heat-resistant film to make possible the use of an insulation layer typically in the range 0.025 to 0.2 mm thick. The actual film thickness for a particular application will be determined primarily on the basis of the safety standard requirements. The film is flexible and adopted to enter spaces between the conductors. In practice it has been found that Kapton® polyimide film manufactured by the DuPont Company satisfactorily meets the requirements of the present invention. Other films having similar properties could also be used.

While practically metals have melting points which are higher than those of plastics, in the present invention the metal alloy used for coating the terminals has a lower meting point than the plastic used to insulate the circuit.

The new insulation method offers many advantages. Among the most important are the following:

In conventionally applied polymeric films as insulation the conductors are regarded as bare with respect to the magnetic core and to neighboring circuits by relevant safety standards. Consequently these standards require fairly high clearances between the coil and the core and neighboring circuits. As in the present invention all sides of the conductor are covered, said standards allow the change of clearance requirement to distance through insulation, which is significantly lower. Clearly, this improves the efficiency of the magnetic circuit.

When a dielectric solidifying coating is applied, thickness is uneven and must be increased to meet the appropriate standard. In contradistinction thereto, the method of the present invention produces a thin covering of uniform thickness, resulting in space savings when the circuits are stacked.

Flexibility in meeting design requirements results from the options of inserting one, two or no insulation sheets between stacked layers.

The space savings made possible by the method of the present invention may be used to produce a more powerful coil in the space required by prior-art planar coils, or in maintaining the same power rating while using a smaller space. Where bobbins were previously used, their elimination provides a similar benefit closer proximity of the coil to the core; aside from saving the cost of the bobbin itself.

The subject of the present invention lends itself particularly to the manufacture of small high-power transformers, which is why the word transformer has been used in describing the coil and its method of manufacture in the present specification. It is however stressed that the same or similar method of manufacture may readily be applied to the manufacture of lead frames, solenoids, motors and other electromagnetic components.

In U.S. Pat. No. 5,949,321 Grandmont et al describe and claim a planar winding assembly which includes first and second windings and a pair of insulative sheet layers, laminated together, with at least one of each pairs of insulative sheets having a hole. For assembly the windings are individually sealed to ensure that they are moisture impervious.

In contradistinction thereto the present specification describes a method wherein several hundred circuits forming parts of a printed circuit board or lead frames may be insulated simultaneously. This is achieved by preparing a stable plastic insulation sheet and accurately punching therein multiple apertures corresponding to the position of the terminals on the printed circuit board or the lead frames. The saving in labor costs effected thereby needs no elaboration.

BRIEF DESCRIPTION OF THE DRAWINGS

The invention will now be described further with reference to the accompanying drawings, which represent by example preferred embodiments of the invention. Structural details are shown only as far as necessary for a fundamental understanding thereof. The described examples, together with the drawings, will make apparent to those skilled in the art how further forms of the invention may be realized.

In the Drawings.

DISCLOSURE OF THE INVENTION

Figure 1:
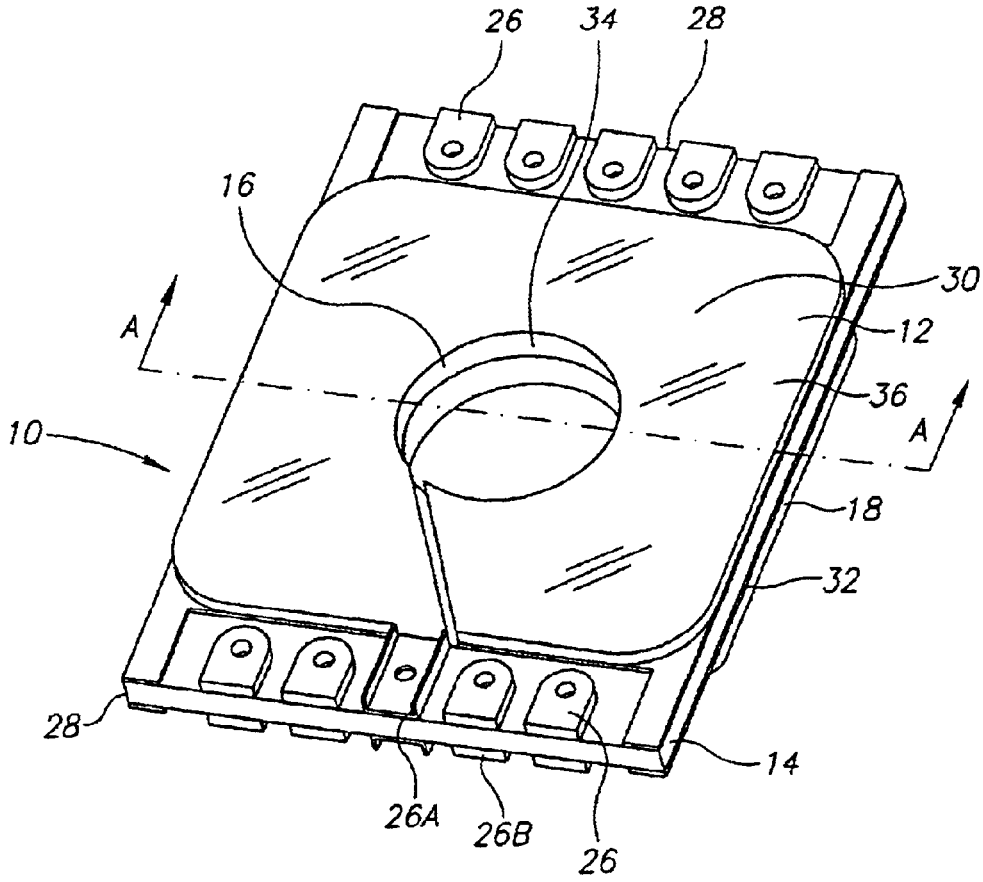
FIG. 1 is a perspective view of a planar circuit component, having been insulated according to the method of the present invention.
Figure 5:
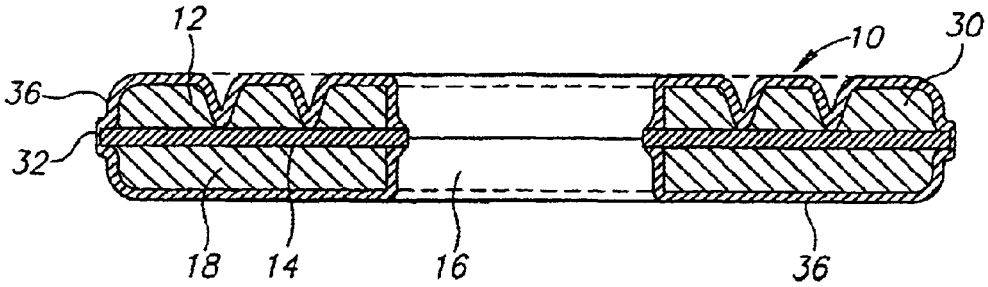
FIG. 5 is a greatly enlarged sectional view, taken on the plane AA, of the component shown in FIG. 1.

There is seen in FIGS. 1 & 5 a planar circuit transformer component 10, A first flat coil 12 projects from a first face of a printed circuit panel 14, and surrounds an aperture 16 sized to allow projection therethrough of a ferrite core member (not shown).

In the preferred embodiment shown the component 10 is double sided, and a second flat coil 18 projects from a second face of printed circuit panel 14.

Figure 2:
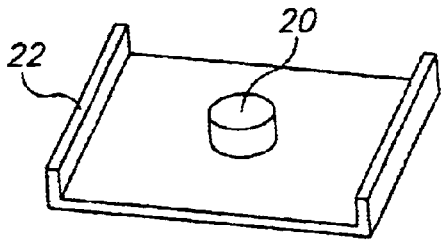
FIG. 2 is a perspective view of a round core member, half of which is shown.
Figure 6:
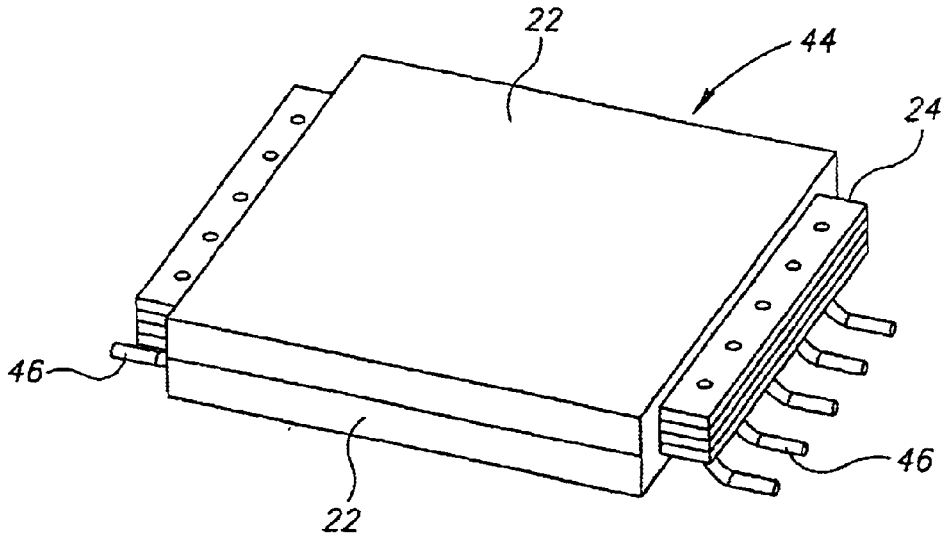
FIG. 6 shows an assembled transformer including pairs of non-similar components originating from a single printed circuit panel.

An example of core member 20 is seen in FIG. 2 which shows a half-casing 22 provided with a ferrite round core 20. A circuit component 24, seen in FIG. 6, is intended to be assembled thereon.

Referring again to FIGS. 1 & 5, terminals 26 for the component are provided adjacent to edges 28 of the panel 14. In the diagram only one terminal 26*a* is seen connected to the coil 12, a further lower terminal 26*b*, only an edge of which is seen, is connected to the lower coil 18. In the shown embodiments the upper and lower coils 12, 18 are electrically interconnected. The redundant terminals 26 are available for interconnecting the coils of adjacent components.

The exposed (prior to having been insulated) face 30 and edges 32 of the coil 12, including the edges 34 of the aperture 16 are insulated by two heat-resisting plastic films 36 (FIG. 3) adhesively attached one on each side of the component 10. The film 36 insulates and adheres to the panel 14, to the coil face 30, and to the coil edges 32, as seen in FIG. 5. The plastic film 36 is preferably polyimide, having a dielectric strength of at least 160 kV/mm. Kapton® manufactured by the DuPont Co. has been found to be suitable.

The invention provides for a method suitable for manufacturing components generally similar to the component 10 described with reference to FIG. 1.

The following is a method for manufacturing a planar transformer component like 10 or lead frame comprising the steps:

STEP A. Manufacturing by prior art methods a printed circuit panel 38 containing an array of individual coil circuit components 10. The circuit components have conductive terminals 37*a*, 37*b*. An example of a printed circuit panel 38 for producing large numbers of components is seen in FIG.

4, Apertures 16 are later being punched proximate to the center of each coil 12 sized to allow subsequent insertion therein of a ferrite core member (not shown).

The printed panel 38 may contain several non-similar components, such as the primary and the secondary coil of a transformer.

STEP B. Providing a sheet 36 of polyimide film, seen in FIG. 3, sized to cover the printed circuit panel 38. The sheet 36 is provided with an array of cut-outs 42 accurately positioned to correspond to the locations of the terminals 37.

The sheet 36 has been pre-coated on at least one side with an inactivated adhesive. Suitable adhesives are acrylic based. A grade of epoxy which can be activated under a combination of heat and pressure can also be used.

STEP C. Positioning the sheet 36 on the circuit panel 38, so that the cut-outs 42 correspond to the locations of the component terminals 37.

STEP D. Stacking a plurality of printed circuit panels 38 and polyimide sheets 36, by means of conforming pressure pads (not shown) and effecting adhesion of the sheet 36 to the panel 38 by applying heat and axial pressure to the stack. Advantageously this step is carried out under vacuum to eliminate possible air bubbles between the sheet 36 and the panel 38.

STEP E. Applying metallic or organic coating to the exposed copper terminals.

STEP F. Cutting the printed circuit panel 38 into components 10, each component 10 carrying at least one coil 12. Cutting can be effected by mechanical means or by known laser, water jet or electron beam methods.

Referring again to FIG. 6, there is seen an example of a transformer assembly 44 built inside a pair of half casings 22 seen in FIG. 2. The stacked components 24 are similar to the component 10 except that a rectangular central aperture is provided. SMT terminals 46 can be soldered to connect to a printed circuit panel.

EXAMPLE 1

Figure 3:
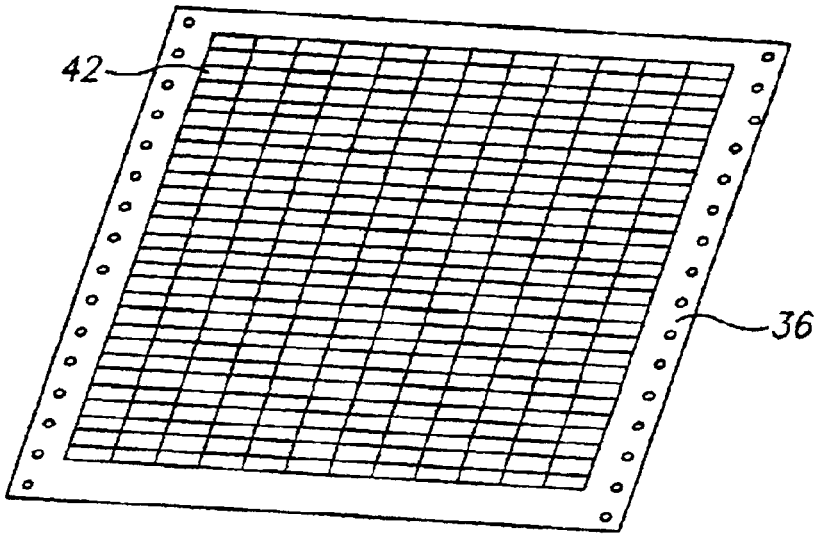
FIG. 3 is a perspective view of a sheet of polyimide film sized to cover a printed circuit panel such as is seen in FIG. 4 and being provided with an array of cut-outs.
Figure 4:
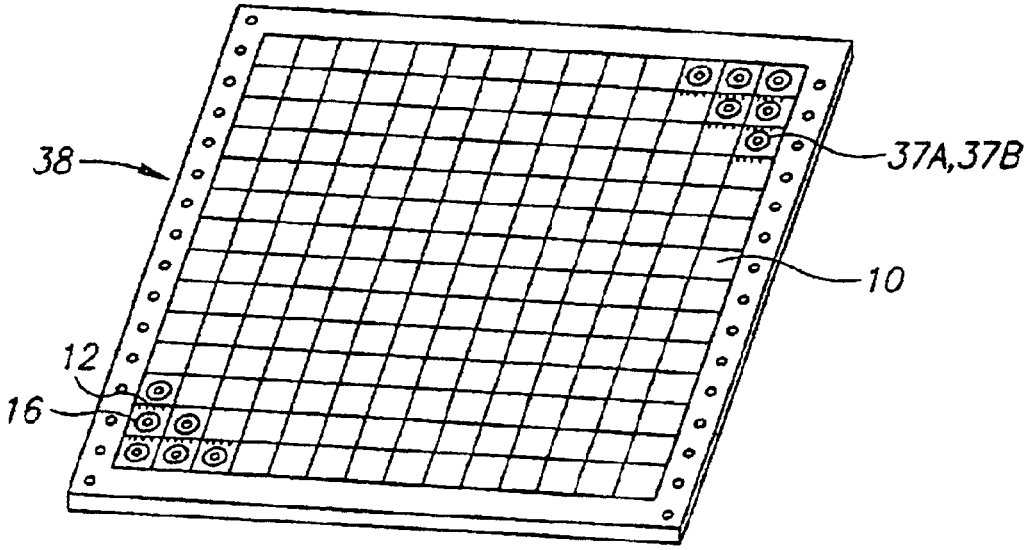
FIG. 4 is a perspective view of a circuit panel suitable for manufacture of the component shown in FIG. 1.

A printed circuit panel was manufactured for an array of 16×13 (total 208) coil components. The panel was double sided, producing a total of 416 coils. The central aperture of the coils was circular. Each component was provided with ten double-sided terminals. Polyimide sheets 0.09 mm thick having an array of 16×13 precision-punched rectangular apertures were adhesively attached, using an acrylic-based or epoxy adhesive, to both faces of the panel. A series of round holes, similar to those used for continuous paper, were provided along major edges of both the panel and the sheet for precision punching and registering holes as shown in FIGS. 3 & 4. The coil layout on a first side of the sheet differed from the coil layout on the second opposite side. The size of the cut transformer coil component, similar to that seen in FIG. 1, was 17×20 mm.

The scope of the described invention is intended to include all embodiments coming within the meaning of the following claims. The foregoing examples illustrate useful forms of the invention, but are not to be considered as limiting its scope, as those skilled in the art will readily be aware that additional variants and modifications of the invention can be formulated without departing from the meaning of the following claims.

What is claimed is:

1. A planar transformer circuit component comprising a flat lead frame coil or a first flat coil projecting from a first face of a printed circuit panel, said coil surrounding an aperture sized to allow projection therethrough of a ferrite core member, terminals for said coil being provided adjacent to an edge of said lead frame or panel, the exposed face and edges of said coil, including the edges of said aperture being insulated by a heat-resisting plastic film adhesively attached to said panel and to said coil face and to said coil edges, said film being provided with cut-outs leaving said terminals exposed for subsequent electrical connection.

2. A planar transformer component as claimed in claim 1, wherein a second flat coil projects from a second face of said printed circuit panel.

3. The planar transformer or lead frame component as claimed in claim 1, wherein said plastic is polyimide.

4. The planar transformer or lead frame component as claimed in claim 3, wherein said polyimide film has a dielectric strength of at least 160 kV/mm.

5. The planar transformer or lead frame component as claimed in claim 3, wherein said polyimide film is Kapton®.

6. A method for manufacturing a planar transformer circuit component comprising the steps:

a) manufacturing by prior art methods a printed circuit panel or solid copper lead frames containing an array of individual coil circuit components, each circuit component having at least two terminals, and apertures being provided proximate to the center of each coil sized to allow insertion therein of a ferrite core member;

b) providing a sheet of polyimide or other polymeric film sized to cover said printed circuit panel or solid copper lead frames, said sheet being provided with an array of cut-outs positioned to correspond to the locations of said terminals, said sheet being coated on at least one side with an inactivated adhesive;

c) positioning said sheet on said circuit panel or copper lead frame panel;

d) stacking a plurality of said printed circuit panels or copper lead frame panels and said sheets and effecting adhesion of said sheet to said panel or copper lead frame panel by applying heat and axial pressure to the stack;

e) if necessary applying a metallic or organic coating to said terminals; and f) cutting said printed circuit or copper lead frame panel into components, each carrying at least one coil.

7. The method as claimed in claim 6, wherein said coating is composed of a tin-lead alloy, or organic coating.

8. The method as claimed in claim 6, wherein said adhesive is acrylic based.

9. The method as claimed in claim 6, wherein said adhesive is an epoxy.

10. The method as claimed in claim 6, wherein step d) is carried out under vacuum.

11. The method as claimed in claim 6, wherein said printed panel or copper lead frame panel contains at least two non-similar components.

12. The method as claimed in claim 11, wherein said two components are the primary and the secondary coil of a transformer.

* * * * *